US005847728A

United States Patent [19]

Lee

[11] Patent Number: 5,847,728

[45] Date of Patent: Dec. 8, 1998

[54] SERVICE STATION DEVICE IN INKJET PRINTER HEAD

[75] Inventor: Yong-duk Lee, Kyunaki-do, Rep. of Korea

[73] Assignee: Samsung Electronics Co., LTD., Rep. of Korea

[21] Appl. No.: 761,334

[22] Filed: Dec. 10, 1996

[30] Foreign Application Priority Data

Dec. 12, 1995 [KR] Rep. of Korea ..... 95-40126

[51] Int. Cl.[6] ..... B41J 2/165

[52] U.S. Cl. ..... 347/33; 347/29

[58] Field of Search ..... 347/22, 29, 33

[56] References Cited

U.S. PATENT DOCUMENTS

| | | | |
|---|---|---|---|
| 5,381,169 | 1/1995 | Arai et al. | 347/33 |
| 5,394,178 | 2/1995 | Grange | 347/33 X |
| 5,396,277 | 3/1995 | Gast et al. | 347/33 |
| 5,517,220 | 5/1996 | English | 347/29 |
| 5,548,310 | 8/1996 | Binnert et al. | 347/33 |
| 5,638,099 | 6/1997 | Nguyen et al | 347/22 |
| 5,659,341 | 8/1997 | Kinas | 347/33 |
| 5,663,751 | 9/1997 | Holbrook | 347/22 |

FOREIGN PATENT DOCUMENTS

| | | | |
|---|---|---|---|
| 0635371A2 | 1/1995 | European Pat. Off. | 347/29 |

*Primary Examiner*—S. Lee

*Attorney, Agent, or Firm*—Banner & Witcoff, LTD.

[57] ABSTRACT

A service station device in an inkjet printer head includes a cap portion which moves together with a case under guide of the case by a pressure force of a carriage moving to a service area for performing next printing and is then ascended to tightly close a nozzle of a head; a wiper portion which moves and is ascended along with the case under the guide of the case, upon movement of the cap portion, to stand by a cleaning state, and upon printing operation, which moves and descends only the cap portion to a printing area and at the same time cleans a surface of the nozzle; a locking portion integrated with the wiper portion as one unit, which moves together with the wiper portion, to thereby be locked to the case during a standby state, and upon the printing operation, returns to an original state with the wiper portion by releasing the standby state by means of the carriage being continuously moved; and an elastic portion coupled to the case and to the locking portion, which is elastically extended to lock the locking portion to the case, upon movement of the locking portion, and at the same time, releases the locking state by the carriage to return the locking portion to the original state.

9 Claims, 8 Drawing Sheets

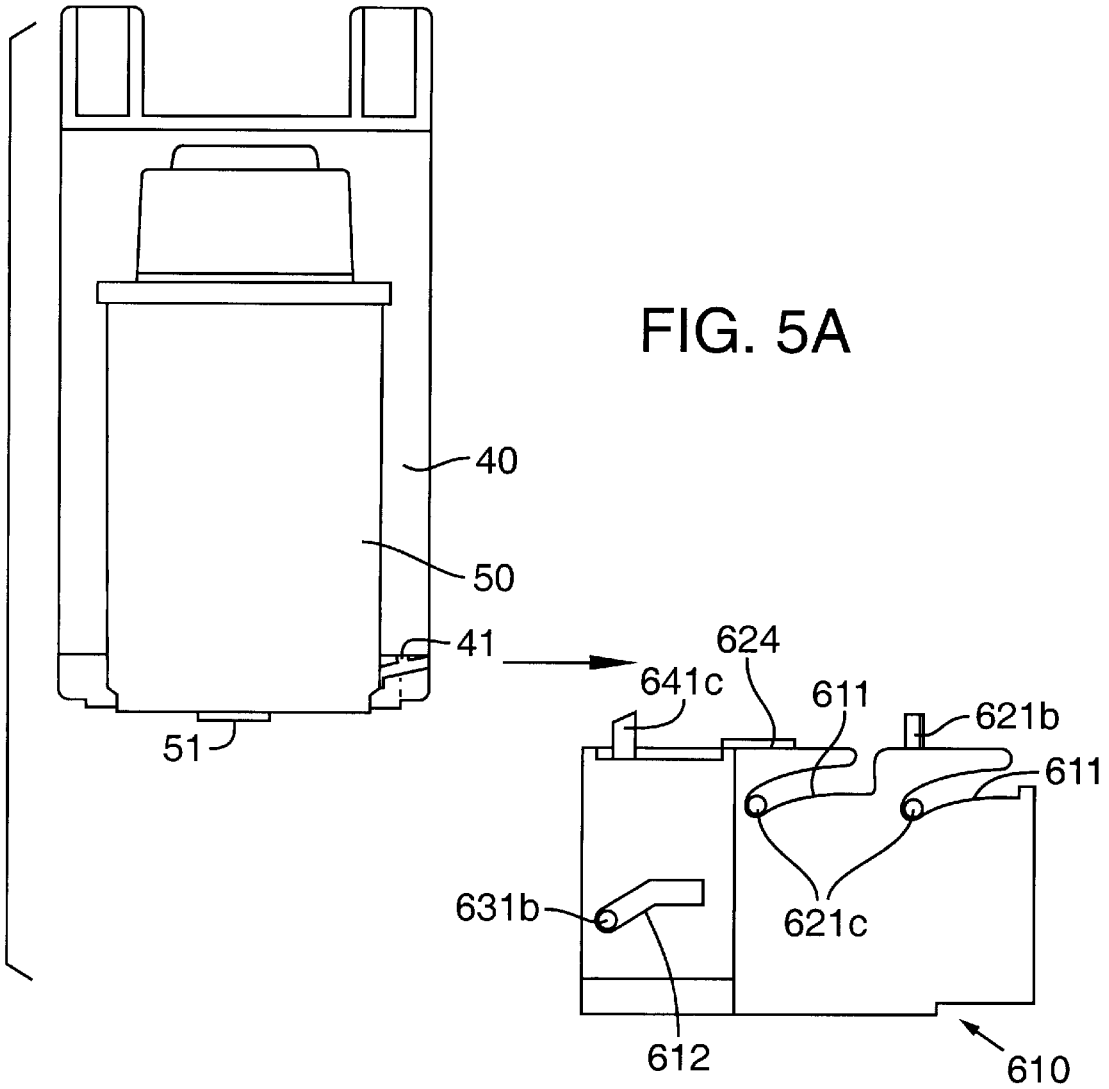
FIG. 5A
FIG. 5B
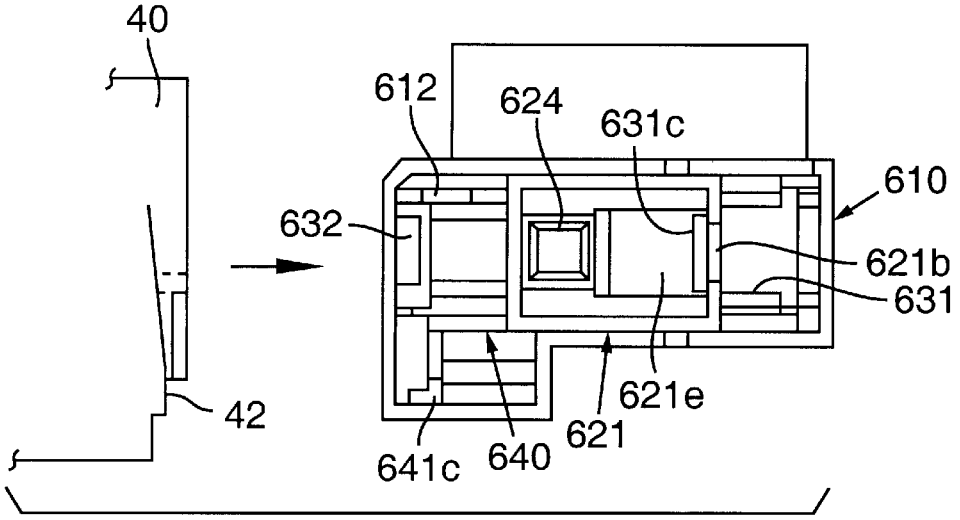

SERVICE STATION DEVICE IN INKJET PRINTER HEAD

BACKGROUND OF THE INVENTION

1. Field of the Invention

The present invention relates to an inkjet printer head, and more particularly, to a service station device in an inkjet printer head which can elastically reinforce a capping force to increase a closing force of a nozzle and to improve a cleaning degree of nozzle, and simultaneously can have a simplified device configuration to achieve a miniaturized size of printer.

2. Discussion of Related Art

Generally, a printer includes a carriage which is supported on a main frame and moves in the left and right directions under the guide of a belt pulley, a head which is mounted in the carriage and is provided with a nozzle for injecting ink in a predetermined pattern, and a service station device which cleans or tightly closes the nozzle of head by a predetermined period according to a cleaning signal during a printing operation.

Meanwhile, the service station device has various types to meet individual head characteristics designed by numerous inkjet printer manufacturers.

In a conventional inkjet print head, however, when the service station device tightly closes the head, the nozzle is sealed to a cap by tare of the head, which makes a reliable degree of the tight closing considerably reduced. Also, since the service station device has a very complicated construction, a large number of assembling parts are needed, and many components are accordingly required in the printer manufacturing, which causes production cost to be high. Furthermore, an additional motor has to be used to perform a closing operation, which also causes production cost to be increased.

In addition, a wiper, which serves to clean a surface of nozzle of the head, exhibits a weakly contact force, which results in decreasing reliability of the wiper. For instance, while the ink remaining in the surface of nozzle is completely dried, a cleaning state of the wiper is not well good, and after the cleaning operation is completed, the wiper returns to a service station side and then has to be descended. This inconveniently needs a double operation.

Further, such a conventional wiper is adapted to move in the upper and lower directions, and accordingly, since the wiper is not moved in the left and right directions, a moving distance of the carriage is increased according to the cleaning and closing operations, which makes the area occupied by the service station device quite large.

SUMMARY OF THE INVENTION

Accordingly, the present invention is directed to a service station device in an inkjet printer head that substantially obviates one or more of the problems due to limitations and disadvantages of the related art.

An object of the present invention is to provide a service station device in an inkjet printer head which can elastically reinforce a capping force to increase a closing force of a nozzle and to improve a cleaning degree of nozzle.

Another object of the invention is to provide a service station device in an inkjet printer head which can have a simplified device configuration to achieve a miniaturized size of printer.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a service station device in an inkjet printer head includes: a cap portion which moves together with a case under guide of the case by a pressure force of a carriage moving to a service area for performing next printing and is then ascended to tightly close a nozzle of a head; a wiper portion which moves and is ascended along with the case under the guide of the case, upon movement of the cap portion, to stand by a cleaning state, and upon printing operation, which moves and descends only the cap portion to a printing area and at the same time cleans a surface of the nozzle; a locking portion integrated with the wiper portion as one unit, which moves together with the wiper portion, to thereby be locked to the case during a standby state, and upon the printing operation, returns to an original state with the wiper portion by releasing the standby state by means of the carriage being continuously moved; and an elastic portion coupled to the case and to the locking portion, which is elastically extended to lock the locking portion to the case, upon movement of the locking portion, and at the same time, releases the locking state by the carriage to return the locking portion to the original state.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings.

In the drawings:

FIGS. 5A and 5B are front and plan views showing a service station device when a carriage is at a printing area;

DETAILED DESCRIPTION OF PREFERRED EMBODIMENT

Figure 1:
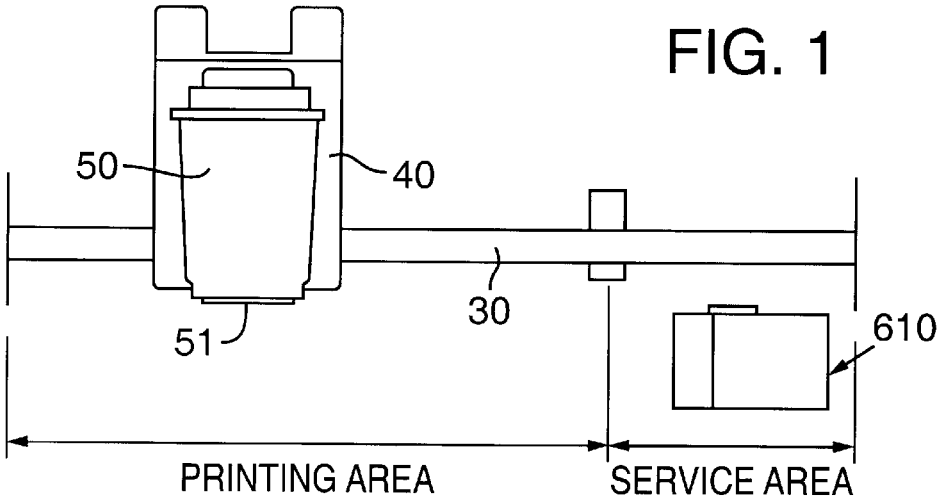
FIG. 1 is a schematic view showing a construction of an inkjet printer according to the present invention.
Figure 2:
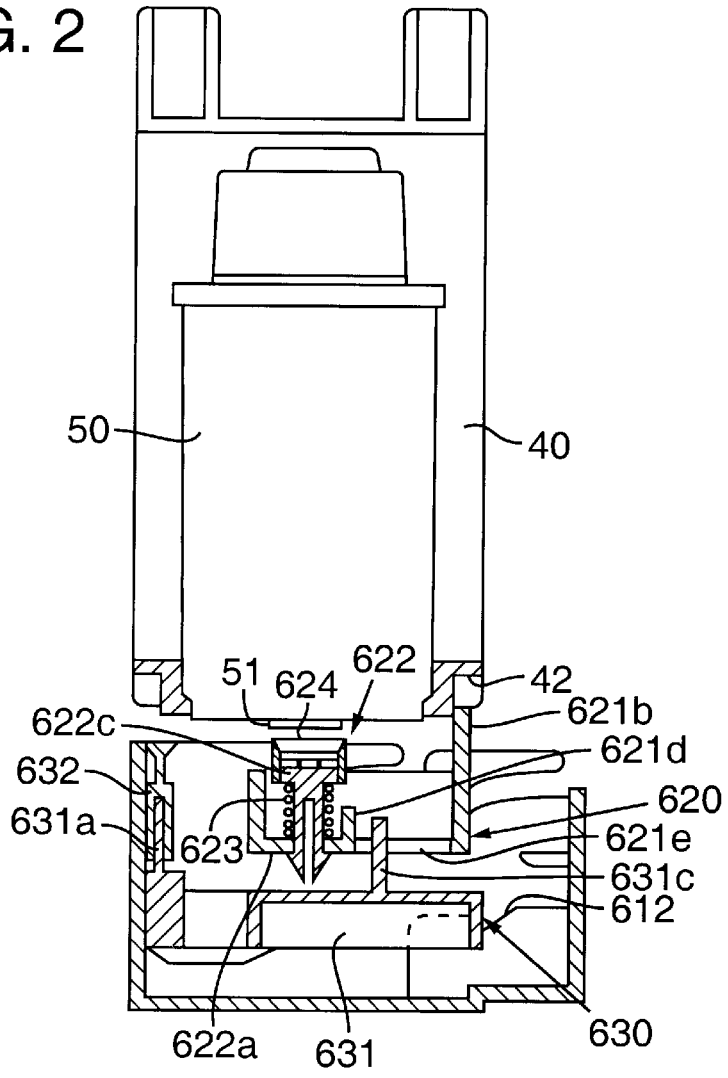
FIG. 2 is a front view, partly broken away, showing main parts of the inkjet printer according to the present invention.
Figure 3:
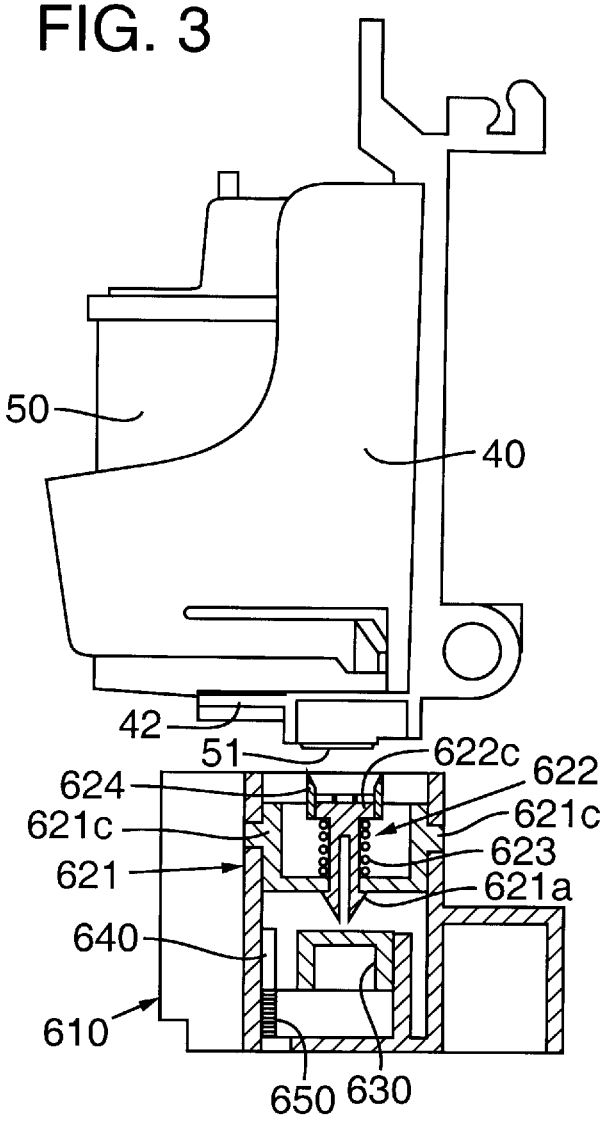
FIG. 3 is a section view, partly in side, of FIG. 2.
Figure 4:
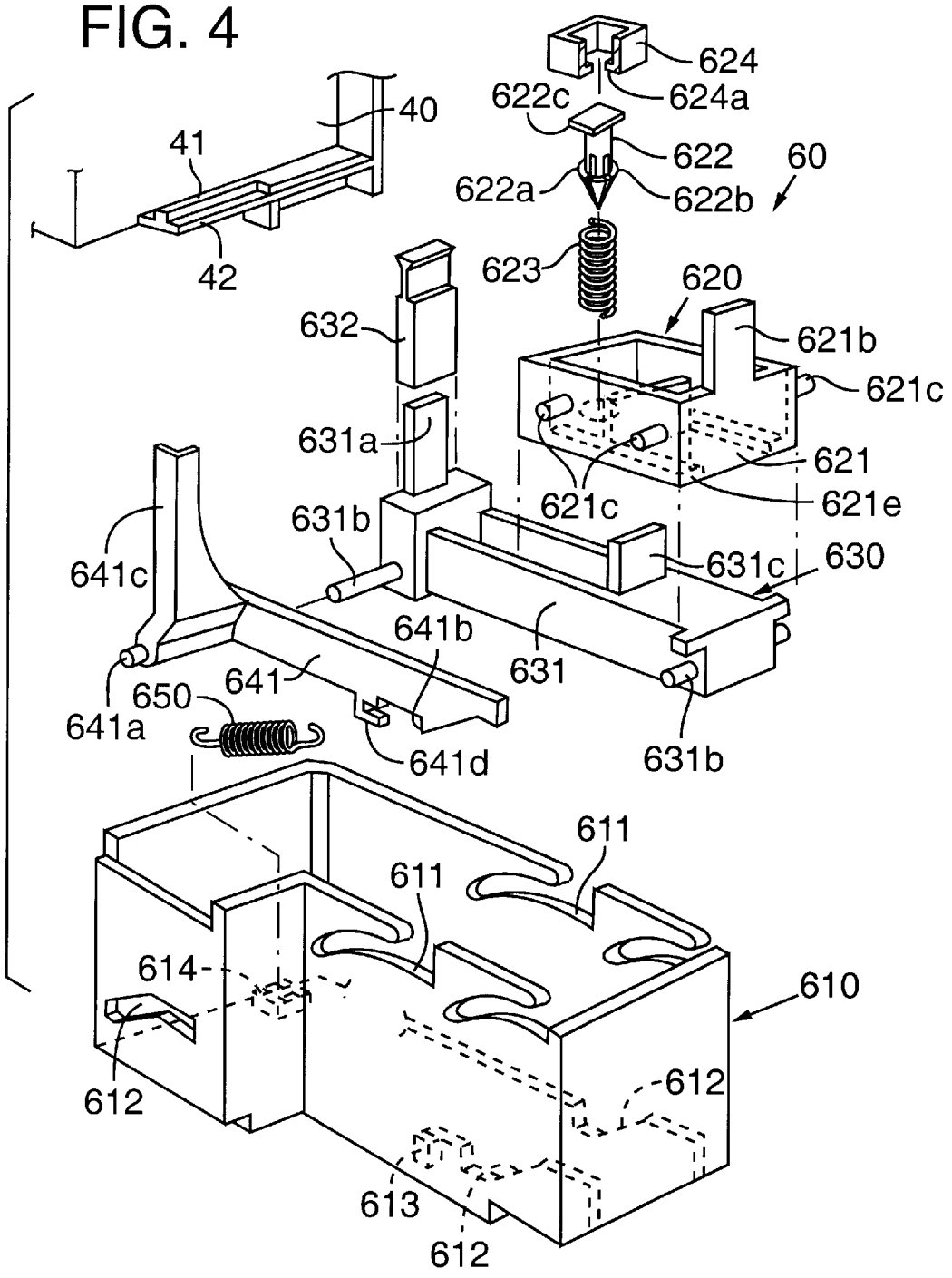
FIG. 4 is an exploded perspective view showing main parts of the inkjet printer according to the present invention.

Reference will now be made in detail to the preferred embodiments of the present invention, examples of which are illustrated in the accompanying drawings.

Referring to FIGS. 1 to 10B, an inkjet printer according to the present invention includes a carriage 40 which is supported on a main frame 10 and moves in the left and right directions by means of a belt 30 under the guide of a belt pulley, a head 50 which is mounted in the carriage 40 and is provided with a nozzle 51 for injecting ink in a predetermined pattern, and a service station device 60 which cleans or tightly closes the nozzle 51 of head 50 by a predetermined period according to a cleaning signal during a printing operation.

The service station device 60 in the inkjet printer according to the present invention includes: a cap portion 620 which moves together with a case 610 under guide of the case 610 by a pressure force of the carriage 40 moving to a service area for performing next printing and is then ascended to tightly close the nozzle 51 of the head 50; a wiper portion 630 which moves and is ascended along with the case 610 under the guide of the case 610, upon movement of the cap portion 620, to stand by a cleaning state, and upon printing operation, which moves and descends only the cap portion 620 to a printing area and at the same time cleans a surface of the nozzle 51; a locking portion 640 integrated with the wiper portion 630 as one unit, which moves together with the wiper portion 630, to thereby be locked to the case 610 during a standby state, and upon the printing operation, returns to an original state with the wiper portion 630 by releasing the standby state by means of the carriage 40 being continuously moved; and an elastic portion 650 coupled to the case 610 and to the locking portion 640, which is elastically extended to lock the locking portion 640 to the case 610, upon movement of the locking portion 640, and at the same time, releases the locking state by the carriage 40 to return the locking portion 640 to the original state.

The cap portion 620 is comprised of a cap case 621 which is provided to be moved in the left and right directions within the case 610, a cap bar 622 which is assembled vertically to a guide opening or pipe 621*a* formed in a bottom surface of the cap case 621 and is moved in the upper and lower directions, an elastic member 623 which is provided between the guide pipe 621*a* and the cap bar 622 to increase a pressure force by elastically supporting the cap bar 622, and a cap 624 which is assembled with the top portion of the cap bar 622 to tightly close the nozzle 51 of the head 50 by a closing force of the elastic member 623.

A hooking protrusion 622*a* is formed in the lower end of the cap bar 622, so that it is hooked in the bottom surface of the cap case 621 to prevent the cap bar 622 from being deviated in the upper direction. Further, a groove 622*b* is formed vertically in the lower end portion of the cap bar 622, so that the lower end of the cap bar 622 is easily inserted into the guide opening or pipe 621*a* of the cap case 621 and then the hooking protrusion 622*a* is hooked to the bottom surface of the cap case 621, thereby enabling the cap bar 622 to be elastically narrow and then return to an original state. A protrusion 622*c* is formed in the upper end of the cap bar 622 to thereby support the elastic member 623 and at the same time, is inserted into a hooking hole 624*a* of a cap 624 to thereby be assembled to be integrated with the cap 624.

A portion of moving and ascending/descending cap portion 620 is comprised of: a pressure projection 41 which is protruded at the right side of the carriage 40; a pressure side 621*b* which is protruded upwards at the right side of the cap case 621 to move the cap portion 620 by the pressure force of the pressure projection 41 when the carriage 40 moves to the service area; circular arc type of guide grooves 611 which are each formed in the same direction to be symmetrized at the left and right portions on the front/rear surfaces of the case 610 to thereby ascend or descend the moving cap portion 620, thus to close or separate the cap portion 620 to/from the nozzle surface; and guide bars 621*c* which are protruded to symmetrically at the left and right portions on the front/rear surfaces of the cap case 621, to thereby move along the guide grooves 611 of the case 610.

The wiper portion 630 includes a wiper guide 631 which is provided at the lower portion of the cap case 621 to move with the cap portion 620 by the guide of the case 610, and a wiper 632 which is inserted into a fixing bar 631*a* protruded at the upper portion of the left side of the wiper guide 631 and serves to clean the nozzle surface of the head 50.

A portion of moving and ascending/descending wiper portion 630 is comprised of: slant guide faces 612 which are each formed in the same direction to be symmetrized at the left and right portions on the front/rear surfaces of the case 610 and move horizontally and ascend/descend slantly the moving wiper portion 630; guide bars 631*b* which are protruded to be symmetrized at the left and right portions on the front/rear surfaces of the wiper guide 631, to thereby move along the slant guide faces 612 of the case 610; a hooking side 631*c* which is protruded upward at the right side of the wiper guide 631 to be hooked to a bottom protrusion 621*d* of the cap case 621, so that the wiper guide 631 is moved together with the cap portion 620 by the guide of the case 610; and an interference protecting space 621*e* which protects an interference generated by means of the hooking side 631*c*, when the cap case 621 is originally returned by the carriage 40.

The locking portion 640 is comprised of: a release lever 42 which is extended-protruded forwardly at the right side of the carriage 40; a locking projection 613 which is protruded upward at the right side of the bottom surface of the case 610; a hinge 641*a* which is mounted into the left guide bar 631*b* of the wiper guide 631, thereby disposing the locking portion 640 at the lower portion of the wiper guide 631, and is swung upward/downward and at the same time ascended/descended along with the wiper portion 630; a locking protrusion 641*b* which is protruded downward at the bottom portion of the right side of the locking portion 640 and is locked to the locking projection 613 of the case 610 upon movement; and a locking guide 641 having a release bar 641*c* which is protruded upward at the front portion of the hinge 641*a* and releases the locking protrusion 641*b* from the locking projection 613, being contacted with the release lever 42 of the carriage 40 moving to the printing area.

The elastic portion 650, which is elastically connected between spring hookers 614 and 641*d* respectively protruded at the lower portion of the left side of the case 610 and the right side of the locking guide 641, to allow the locking protrusion 641*b* of the locking guide 641 to be locked to the locking projection 613 of the case 610 and simultaneously, upon release of the locking state, to allow the wiper portion 630 and the locking portion 640 to originally return to the left side. In the case, the elastic portion 650 and the elastic member 623 are all comprised of a coil spring.

Under the construction mentioned in the above, an operational effect of a service station device in an inkjet printer head according to the present invention will be discussed with reference to FIGS. 5 to 10A and 10B.

When the carriage 40 moves from the printing area to the service area as shown in FIGS. 5A and 5B under the control of a control unit, the carriage 40 moves to the service station device 60 and then passes the wiper 632 of the wiper portion 630. At the time, since the wiper portion 630 is not moved and ascended to the right side, the nozzle surface of the head 50 mounted in the carriage 40 is not cleaned.

Figure 6A:
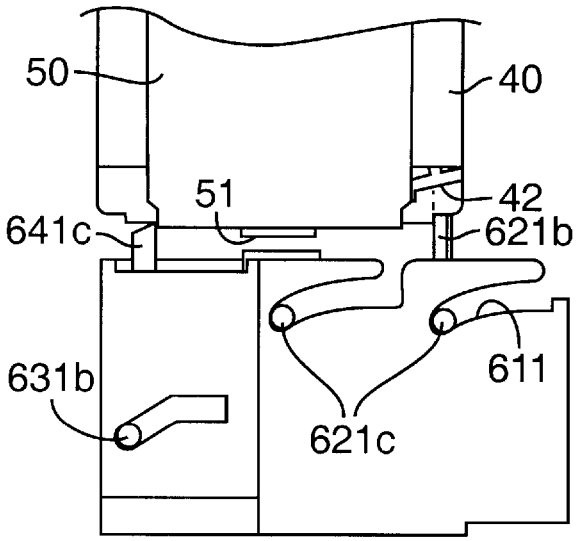
FIGS. 6A and 6B are front and longitudinal sectional views showing a service station device being in contact with a cap portion when a carriage moves to a service area.
Figure 6B:
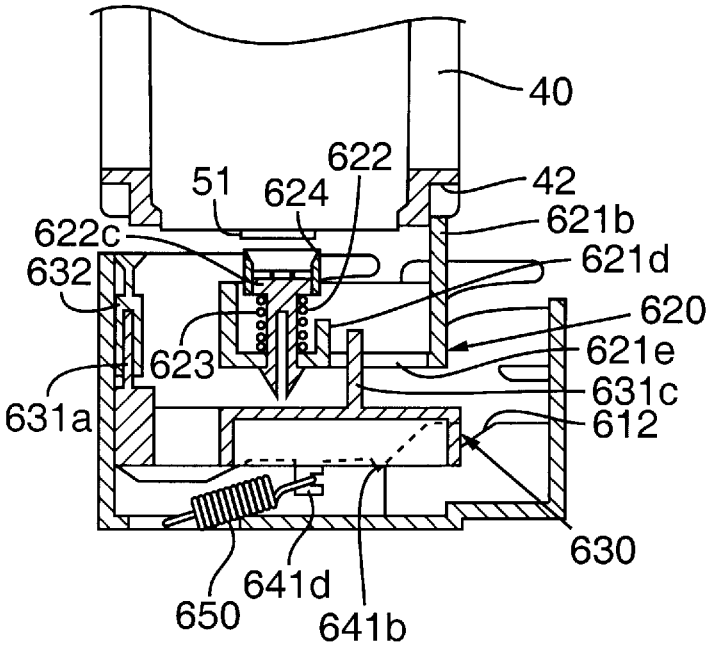

When the carriage 40 continuously moves towards the right side and passes the upper portion of the cap portion 620, the pressure projection 41 of the carriage 40 pushes the pressure side 621*b* of the cap case 621 as shown in FIGS. 6A and 6B. Next, the pressure side 621*b* is moved towards the right side with the pressure projection 41, and the cap case 621 as integrated with the pressure side 621*b* is also moved towards the right side by the guide of the case 610.

According to the movement of the cap case 621 towards the right side, the guide bars 621*c* each protruded to be symmetrized at the left and right portions on the front/rear surfaces of the cap case 621 are increasingly ascended along with the guide grooves 611 each formed in the same direction to be symmetrized at the left and right portions on the front/rear surfaces of the case 610. Upon the ascent of the cap case 621, the cap 624 which is assembled as integrated with the cap case 621 is increasingly ascended, at the same time. When the carriage 40 reaches a predetermined position, the cap case 621 and the cap 624 are completely ascended to a predetermined height, so that the cap 624 can tightly close the nozzle 51 of the head 50.

At the moment, the predetermined height of the cap 624 is adapted to be ascended higher than that of the nozzle 51 by means of the cap bar 622, but is not any more ascended by the height limit of the nozzle 51. At the same time, the cap bar 622 is descended by a height difference between the cap 624 and the nozzle 51 under the guide opening or of the guide pipe 621*a*. The cap bar 622 can be elastically descended regardless of the elastic member 623 as well as can be elastically supported by the elastic member 623, so that the cap 624 can have a strong closing force for the nozzle 51 to previously prevent the ink within the nozzle 51 from being dried.

Figure 7A:
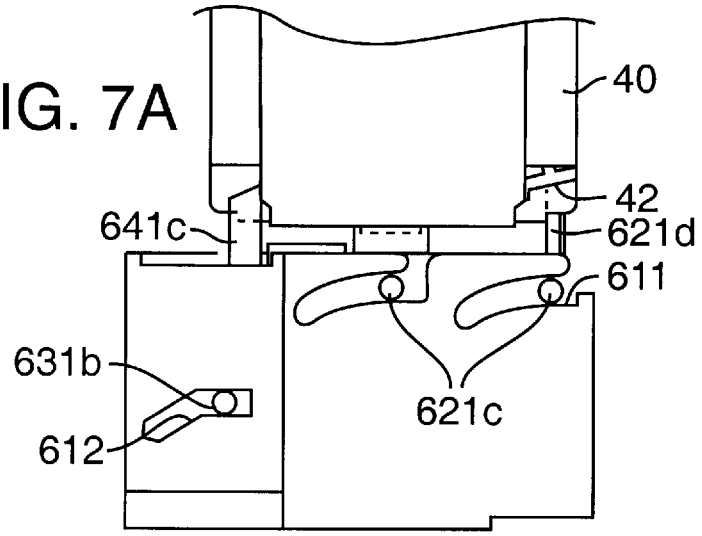
FIGS. 7A and 7B are front and longitudinal sectional views showing a service station device in a closed state when a carriage pushes a cap portion.
Figure 7B:
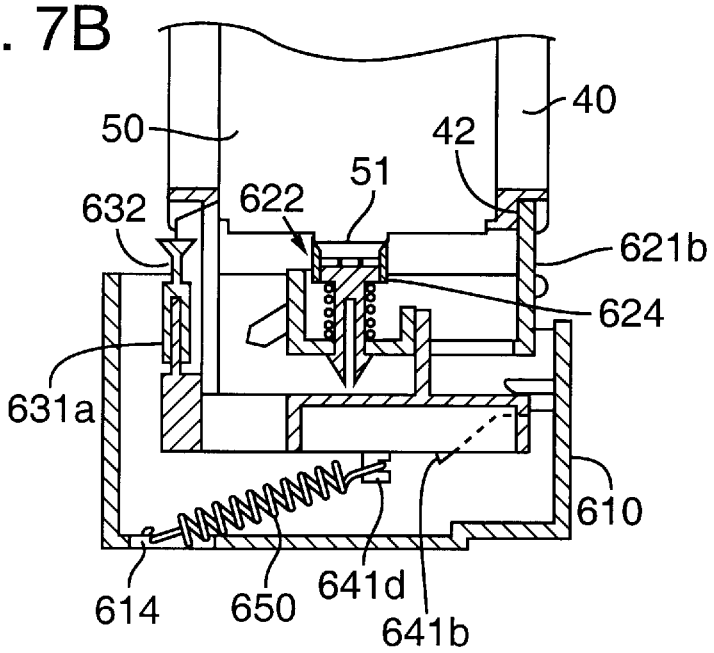

Meanwhile, when the cap portion 620 is moved and ascended towards the right side by means of the carriage 40, as shown in FIGS. 7A and 7B, the hooking side 631*c* of the wiper guide 631 within the wiper portion 630 which is hooked to the bottom protrusion 621*d* of the cap case 621 moves together with the cap case 621. Concurrently, since the wiper guide 631 as integrated with the hooking side 631*c* moves towards the right side, the guide bars 631*b* which are each protruded to be symmetrized at the left and right portions on the front/rear surfaces of the wiper guide 631 are ascended and horizontally moves by the guide of the slant guide faces 612 which are each formed in the same direction to be symmetrized at the left and right portions on the front/rear surfaces of the case 610.

At the time, the wiper 632 as integrated with the wiper guide 631 is ascended and moves horizontally to maintain its upper end at the horizontal state, thereby cleaning the nozzle surface of the head 50.

Upon ascent and horizontal movement of the wiper portion 630, the locking portion 640 mounted into the left guide bar 631*b* of the wiper guide 631 is also ascended and moves horizontally. At the time, the elastic portion 650 coupling the case 610 to the locking portion 640 is elastically extended. When the locking portion 640 fully moves towards the right side, the locking protrusion 641*b* passes the locking projection 613 of the case 610 and immediately the locking protrusion 641*b* is locked to the locking projection 613 by the elastic force of the elastic portion 650, thereby holding a locking state.

Namely, when the locking protrusion 641*b* of the locking portion 640 passes the locking projection 613 of the case 610, the hinge 641*a* of the locking portion 640 is somewhat lifted upwards around the guide bar 631*b* of the wiper portion 630 and then allows the locking protrusion 641*b* to be naturally passed through the locking projection 613. At the time, the elastic force of the elastic portion 650 is effected to lock the locking protrusion 641*b* to the locking projection 613.

Next, if the nozzle surface of the head 50 is to be cleaned, when the carriage 40 moves to the printing area under a signal of the control unit, the cap 624 of the cap portion 620 which has closed the nozzle 51 of the head 50 moves towards the left side together with the carriage 40.

Figure 8B:
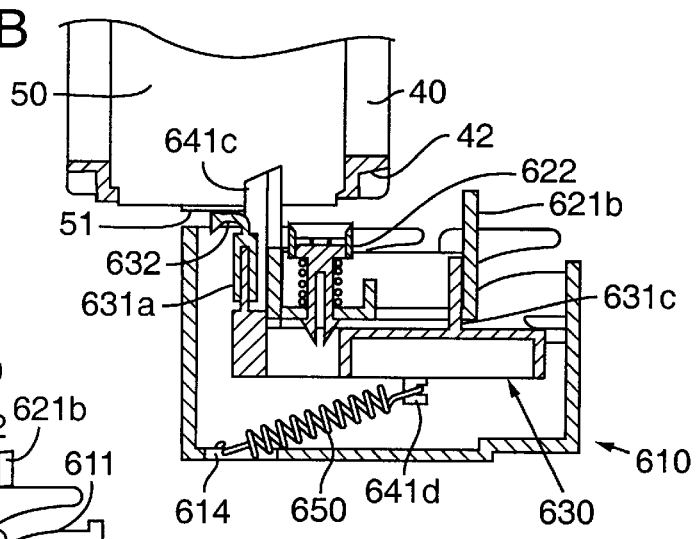
FIGS. 8A and 8B are front and longitudinal sectional views showing a service station device which returns a cap portion to an original position and concurrently executes a cleaning operation when a carriage moves to a printing area.
Figure 8A:
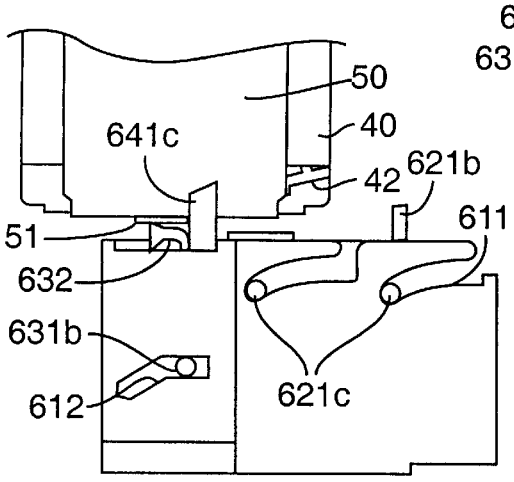

At the time, the cap case 621 assembled with the cap 624 of the cap portion 620 is also moved towards the left side, and is descended as the guide bars 621*c* each protruded to be symmetrized at the left and right portions on the front/rear surfaces thereof are moved along with the guide grooves 611 each formed in the same direction to be symmetrized at the left and right portions on the front/rear surfaces of the case 610. At the same time, the elastic member 623 which elastically closes the cap 624 to the nozzle 51 of the head 50 facilitates a descending movement of the cap case 621. Accordingly, as shown in FIGS. 8A and 8B, because of the movement towards the left side and the descending movement of the cap case 621, the cap 624 assembled with the cap case 621 as one unit is deviated from the nozzle 51 of the head 50 and returns to an original position.

At the moment, upon the movement of the cap portion 620 towards the left side, the wiper portion 630 remains at the locking state by the locking projection 630 of the case 610, and thus only the cap portion 620 is moved towards the left side and descended. When the cap case 621 is moved towards the right side as discussed in the above, the hooking side 631*c* of the wiper portion 630 hooked in the bottom protrusion 621*d* of the cap case 621 is fixed at the moved state towards the right side. Accordingly, when only the cap portion 620 returns tothe original position, the interference protecting space 621*e* of the cap case 621 is not locked to the hooking side 631*c* and is naturally moved to the left side.

According to the continuous movement of the carriage 40 to the left side, since the nozzle surface becomes in contact with the wiper 632 of the wiper portion 630 which is already ascended, a waste ink or dusts remaining on the nozzle surface is cleaned by the acute front end of the wiper 632.

Figure 9B:
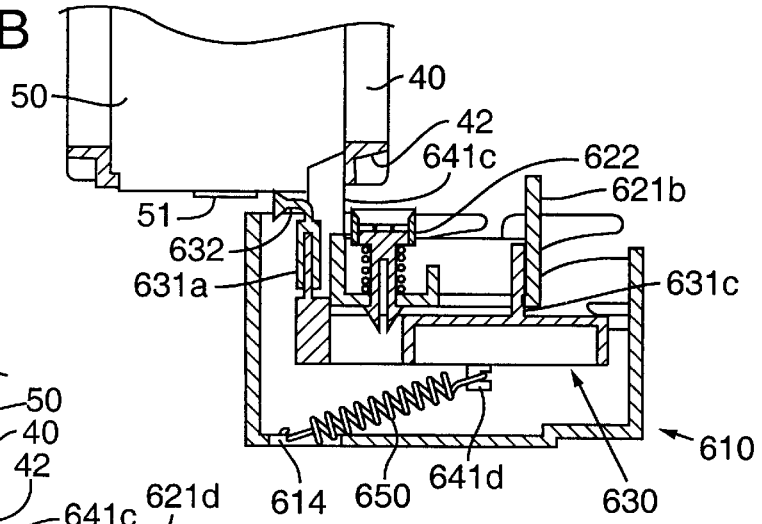
FIGS. 9A and 9B are front and longitudinal sectional views showing a service station device which releases a locking portion while a carriage moves to a printing area.
Figure 9A:
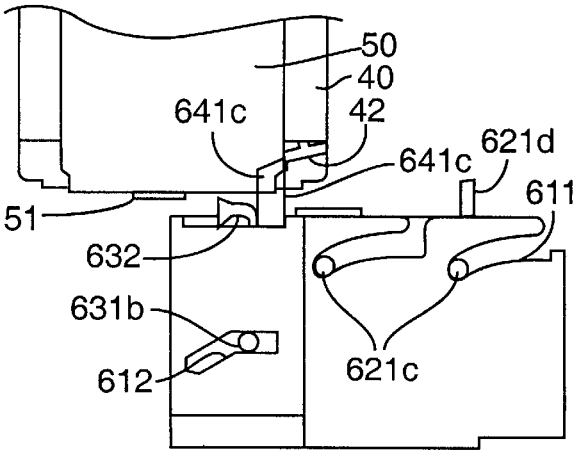

When the nozzle surface of the head 50 is cleaned and passes the wiper 632, the release lever 42 protruded extendedly at the right side of the carriage 40 comes in contact with the release bar 641*c* of the locking guide 641 and pushes it to the left side, as shown in FIGS. 9A and 9B. As the locking guide 641 is rotary in a counterclockwise direction around the hinge 641*a* by means of the release bar 641*c*, the locking protrusion 641*b* of the locking guide 641 is released from the locking projection 613 of the case 610. At the time, the elastic force of the extended elastic portion 650 pulls the locking guide 641 towards the left side, and the locking guide 641 is moved and descended to the left side together with the wiper portion 630 by means of the elastic portion 650, thereby returning to the original position.

Figure 10A:
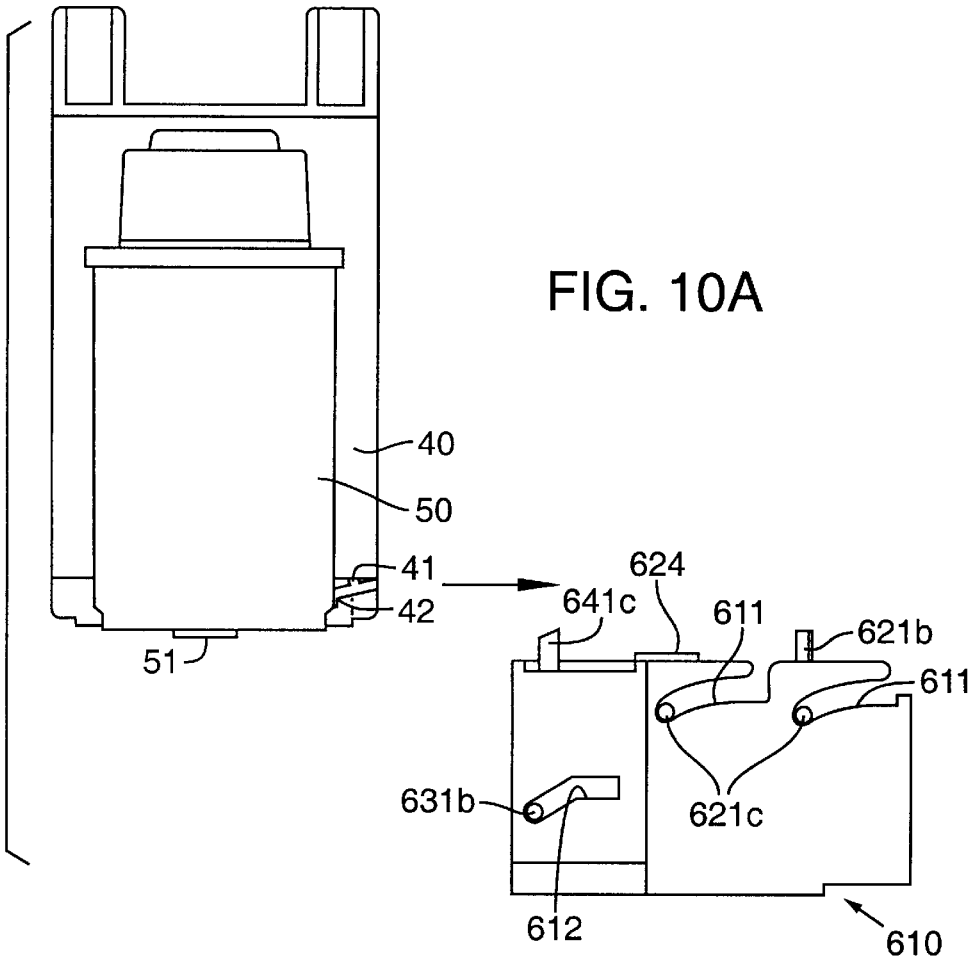
FIGS. 10A and 10B are front and longitudinal sectional views showing a service station device when a carriage passes the service station device and moves to a printing area.
Figure 10B:
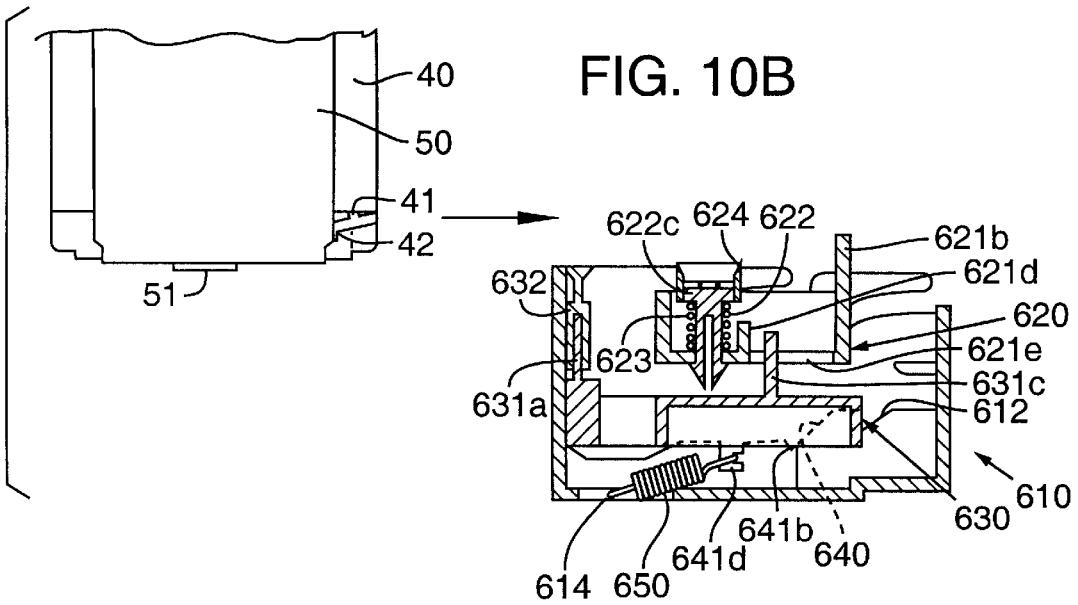

Namely, the guide bar 631*b* of the wiper portion 630 is descended and moves to the left side under the guide of the slant guide faces 612 of the case 610, thereby returning to the original position, as shown in FIGS. 10A and 10B.

The waste ink or dusts eliminated by the cleaning of the nozzle surface of the head 50 is dropped towards the lower portion of the case 610 and is then accumulated in a felt. Accordingly, as a series of closing, cleaning and waste ink storing processes are repeated, an improvement of the print quality can be ensured.

As discussed in the above, a service station device in an inkjet printer head according to the present invention has various advantages as follows: since a nozzle is not sealed to a cap by tare of the head, but is closed by the elastic force of an elastic member supporting the cap, the reliability of closing of the cap can be increased, and since the construction of the device is simple, the number of assembling parts can be reduced and accordingly production cost can be lowered. Furthermore, since a wiper for cleaning a nozzle surface of the head has a high degree of contact force, the reliability of wiper can be improved and at the same time, the movement of carriage to a printing area can be easily achieved. Moreover, since the wiper can be freely moved in the upper/lower and left/right directions to thereby reduce amoving distance of the carriage according to the cleaning and closing operations, the size of device can be miniaturized.

It will be apparent to those skilled in the art that various modifications and variations can be made in a service station device in an inkjet printer head of the present invention without departing from the spirit or scope of the invention. Thus, it is intended that the present invention cover the modifications and variations of this invention provided they come within the scope of the appended claims and their equivalents.

What is claimed is:

1. A service station device in an inkjet printer head, comprising:

a cap portion for moving together with a case under guide of the case by a pressure force of a carriage moving to a service area for performing next printing and for being ascended to tightly close a nozzle of a head;

a wiper portion for moving and being ascended along with said case under the guide of said case, upon movement of said cap portion, to stand by a cleaning state, and upon printing operation, for moving and descending only said cap portion to a printing area and at the same time for cleaning a surface of said nozzle;

a locking portion integrated with said wiper portion as one unit for moving together with said wiper portion, to thereby be locked to said case during a standby state, and upon the printing operation, for returning to an original state with said wiper portion by releasing the standby state by means of said carriage being continuously moved; and an elastic portion coupled to said case and to said locking portion, for being elastically extended to lock said locking portion to said case, upon movement of said locking portion, and at the same time, for releasing the locking state by said carriage to return said locking portion to the original state.

2. The device as defined in claim 1, wherein said cap portion is comprised of:

a cap case provided to be moved in left and right directions within said case;

a cap bar assembled vertically to a guide opening formed in a bottom surface of said cap case and moved in up and down directions;

an elastic member provided between said guide opening and said cap bar to increase a pressure force by elastically supporting said cap bar; and a cap made of a rubber material and assembled with a top portion of said cap bar to tightly close said nozzle of said head by a closing force of said elastic member.

3. The device as defined in claim 2, wherein said cap bar is comprised of:

a hooking protrusion formed in a lower end thereof, for being hooked in the bottom surface of said cap case to prevent said cap bar from being deviated in an upward direction; and a groove formed vertically in the lower end thereof, so that the lower end of said cap bar is easily inserted into said guide opening of said cap case and said hooking protrusion is then hooked to the bottom surface of said cap case, thereby enabling said cap bar to be elastically narrow and then return to an original state.

4. The device as defined in claim 2, wherein said cap bar is further comprised of a protrusion formed in an upper end of said cap bar to thereby support said elastic member and at the same time, to be inserted into a hooking hole of said cap to thereby be assembled to be integrated with said cap.

5. The device as defined in claim 2, wherein a portion of moving and ascending/descending said cap portion is comprised of:

a pressure projection protruded at a right side of said carriage;

a pressure side protruded upwards at a right side of said cap case to move said cap portion by a pressure force of said pressure projection, when said carriage moves to the service area;

circular arc type of guide grooves each formed in one direction to be symmetrized at left and right portions on front and rear surfaces of said case to thereby ascend or descend said cap portion moving, thus to close said cap portion to the nozzle surface or separate said cap portion from the nozzle surface; and guide bars each protruded to be symmetrized at left and right portions on front and rear surfaces of said cap case, to thereby move along said guide groves of said case.

6. The device as defined in claim 2, wherein said wiper portion is comprised of:

a wiper guide provided at a lower portion of said cap case to move with said cap portion by the guide of said cap case; and a wiper inserted into a fixing bar protruded at an upper portion of a first side of said wiper guide and serving to clean the nozzle surface of said head.

7. The device as defined in claim 6, further comprising:

slant guide faces each formed in one direction to be symmetrized at left and right portions on front and rear surfaces of said case and extending horizontally and slantly to guide said wiper portion motion in ascending and descending directions;

guide bars protruded to be symmetrized at left and right portions on front and rear surfaces of said wiper guide, to thereby be received in and move along said slant guide faces of said case;

a hooking side protruded upward at a second side of said wiper guide to be hooked to a bottom protrusion of said cap case, so that said wiper guide is moved together with said cap portion by the guide of said case; and an interference protecting space for protecting an interference generated by means of said hooking side, when said cap case is originally returned by said carriage.

8. The device as defined in claim 7, wherein said locking portion is comprised of:

a release lever extendedly protruded to a front side at a right side of said carriage;

a locking projection protruded upward at a right side of a bottom surface of said case;

a hinge mounted into a left one of said guide bars of said wiper guide, for disposing said locking portion at a lower portion of said wiper guide, and being swung upward and downward and at the same time ascending or descending along with said wiper portion;

a locking protrusion protruded downward at a bottom portion of a right side of said locking portion and locked to said locking projection of said case upon movement; and a locking guide having a release bar which is protruded upward at a front portion of said hinge and releases said locking protrusion from said projection, being contacted with said release lever of said carriage moving to the printing area.

9. The device as defined in claim 8, wherein said elastic portion is elastically connected between spring hookers respectively protruded at a lower portion of a left side of said case and a right side of said locking guide, to allow said locking protrusion of said locking guide to be locked to said locking projection of the case and simultaneously, upon release of a locking state, to allow said wiper portion and said locking portion to return to said original state.

* * * * *